US008639400B1

(12) United States Patent
Wong

(10) Patent No.: US 8,639,400 B1
(45) **Date of Patent: *Jan. 28, 2014**

(54) ALTITUDE CONTROL OF AN INDOOR FLYING TOY

(71) Applicant: Silverlit Limited, Causeway Bay (HK)

(72) Inventor: Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 0 days.

This patent is subject to a terminal disclaimer.

(21) Appl. No.: 13/837,547

(22) Filed: Mar. 15, 2013

Related U.S. Application Data

(63) Continuation-in-part of application No. 13/627,948, filed on Sep. 26, 2012.

(51) Int. Cl.
*A63H 27/133* (2006.01)

(52) U.S. Cl.
USPC ..... 701/4; 701/16; 701/300; 701/301; 446/36; 244/17.13; 244/76 R

(58) Field of Classification Search
USPC ..... 701/4, 5, 9, 11, 16, 300, 301; 244/17.11, 17.13, 76 R
See application file for complete search history.

(56) References Cited

U.S. PATENT DOCUMENTS

| | | | | |
|---|---|---|---|---|
| 333,805 | A | | 1/1886 | Yagn |
| 2,256,918 | A | | 9/1941 | Young |
| 2,344,266 | A | | 3/1944 | Reissner |
| 2,382,431 | A | | 8/1945 | Loth et al. |
| 2,650,046 | A | | 8/1953 | Vanderlip |
| 2,873,075 | A | | 2/1959 | Mooers et al. |
| 2,957,687 | A | | 10/1960 | Chillson et al. |
| 3,093,807 | A | * | 6/1963 | Crane et al. ..... 367/95 |
| 3,096,046 | A | * | 7/1963 | Kendall, Jr. et al. ..... 244/17.13 |
| 3,102,263 | A | | 8/1963 | Meyer |
| 3,375,518 | A | | 3/1968 | Mader et al. |
| 4,914,734 | A | | 4/1990 | Love et al. |
| 4,929,949 | A | * | 5/1990 | Yamamoto et al. ..... 341/176 |
| 5,195,039 | A | | 3/1993 | Gold et al. |
| 5,371,581 | A | | 12/1994 | Wangler et al. |
| 5,634,839 | A | | 6/1997 | Dixon |

(Continued)

FOREIGN PATENT DOCUMENTS

| | | |
|---|---|---|
| EP | 1 354 220 A1 | 10/2003 |
| FR | 2820216 A1 | 8/2002 |

(Continued)

*Primary Examiner* — Thomas Black
*Assistant Examiner* — Peter D Nolan
(74) *Attorney, Agent, or Firm* — Greenberg Traurig, LLP

(57) ABSTRACT

Altitude control of a toy flying vehicle intended for indoor hovering flight comprises providing a selected altitude level for the vehicle. A position control signal is transmitted from the vehicle towards a surface. A receiver in the vehicle receives the signal reflected from the surface. A level of the reflected signal by the receiver is determined, and a change of the reflected signal is an indicator of a change of altitude of the vehicle relative to the selected altitude level. The vehicle receiver communicates with the remote controller, and the remote controller can adjust and control speed and direction of the vehicle. Controlling the altitude can be by a stop control; an up and/or down control; and/or a high and/or low height sensitivity control, take-off/landing control; gesture mode control; left/right trim control; control between altitude control mode and manual control mode.

24 Claims, 16 Drawing Sheets

(56) References Cited

U.S. PATENT DOCUMENTS

| | | | | |
|---|---|---|---|---|
| 6,260,796 | B1 | 7/2001 | Klingensmith | |
| 6,434,085 | B1 * | 8/2002 | Nedwell | 367/100 |
| 6,445,333 | B1 * | 9/2002 | Tanaka | 341/176 |
| 7,100,866 | B2 | 9/2006 | Rehkemper et al. | |
| 7,248,208 | B2 * | 7/2007 | Hager et al. | 342/120 |
| 7,339,684 | B2 | 3/2008 | Njolstad | |
| 7,400,950 | B2 | 7/2008 | Reich | |
| 7,440,826 | B2 * | 10/2008 | Franceschini et al. | 701/4 |
| 8,200,375 | B2 * | 6/2012 | Stuckman et al. | 701/2 |
| 8,287,326 | B2 * | 10/2012 | Huang et al. | 446/31 |
| 8,380,368 | B2 * | 2/2013 | Stuckman et al. | 701/3 |
| 2003/0112705 | A1 * | 6/2003 | Nedwell | 367/100 |
| 2004/0088079 | A1 | 5/2004 | Lavarec et al. | |
| 2008/0076320 | A1 * | 3/2008 | Van De Rostyne | 446/45 |
| 2009/0069956 | A1 * | 3/2009 | Taya et al. | 701/2 |
| 2010/0161155 | A1 | 6/2010 | Simeray | |
| 2010/0210169 | A1 * | 8/2010 | Rohr | 446/36 |
| 2012/0029738 | A1 * | 2/2012 | Brunetti et al. | 701/11 |
| 2012/0173053 | A1 * | 7/2012 | Ohtomo et al. | 701/4 |

FOREIGN PATENT DOCUMENTS

| | | | | |
|---|---|---|---|---|
| JP | 2009279368 | A | * | 12/2009 |
| WO | WO 02/059646 | A1 | | 8/2002 |
| WO | WO 03/067351 | A2 | | 8/2003 |

* cited by examiner

ALTITUDE CONTROL OF AN INDOOR FLYING TOY

RELATED APPLICATION

This application is continuation-in-part of U.S. patent application Ser. No. 13/627,948, filed Sep. 26, 2012 entitled ALTITUDE CONTROL OF AN INDOOR VERTICAL FLYING TOY. This application is incorporated by reference in its entirety.

BACKGROUND

This disclosure relates to a flying vehicle and more specifically to a hovering vehicle that includes a control system to automatically control the height of the vehicle relative to a surface or another object.

The control method is basically related to the distance measurement. Some flying toys handle it with ultrasonic sensor. A MCU connects to this sensor; it starts the timer while emitting a pulse train from the sensor. MCU then measures the time elapsed of reflected signal from the ground surface. As the speed of sound is known, the distance travelled can be calculated. The limitation of this application is that this sensor is comparatively large and heavy for putting into a small flying toy with size less than 250 mm in length.

Alternatively, precise pressure sensor can be used to level the absolute altitude for both indoor and outdoor flying toys but the solution cost is too high to be applied in toys market and the data is drifted from time to time.

SUMMARY

In present disclosure, a control method is used to maintain stable altitude control of an indoor vertical flying toy such as helicopter or multi-rotor copter. With this altitude hold function, it is easy for beginners to have hover fight and it can avoid the flying toy from being crashed to the ceiling if they are not familiar with throttle control.

By being able to define and retain the distance from a ceiling below which the craft should fly or hover a significant advantage is attained with the method, system, and toy of the disclosure.

Further features can include one or more of an emergency stop control which can be in the sense of a control button; an up and/or down control which can be a single or multiple control button; and a high and/or low height sensitivity control, take-off/landing control; gesture mode control; left/right trim control; control between altitude control mode and manual control mode.

Many advantages and features of the disclosure will become readily apparent from the following detailed description of the disclosure and the embodiments thereof, and from the accompanying drawings.

DRAWINGS

The above-mentioned features and objects of the present disclosure will become more apparent with reference to the following description taken in conjunction with the accompanying drawings wherein like reference numerals denote like elements and in which:

FIG. 1 is perspective view of a helicopter and also showing transmitter.

FIG. 2*a* is a perspective view of a co-axial type helicopter.

FIG. 2*b* is a perspective view of a multi-rotor copter.

Figure 5A:
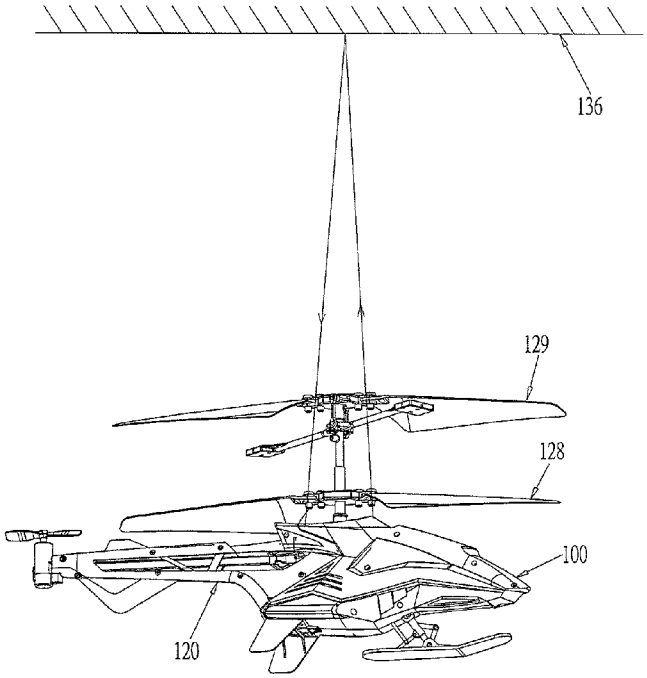

FIG. 5*a* is a perspective view of the present disclosure showing the helicopter having ceiling altitude hold control.

Figure 5B:
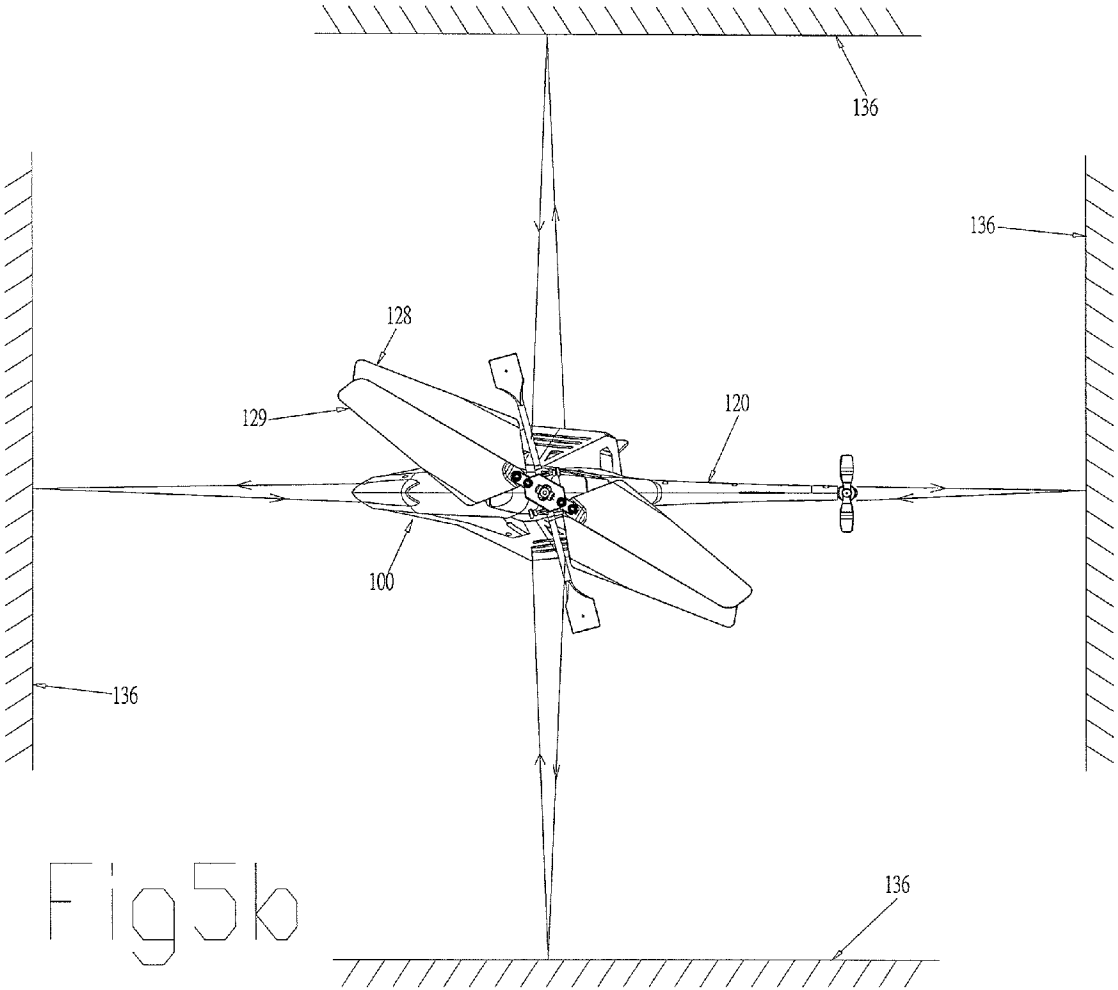

FIG. 5*b* is a perspective view of the present disclosure showing the helicopter having obstacle avoidance control.

Figure 6A:
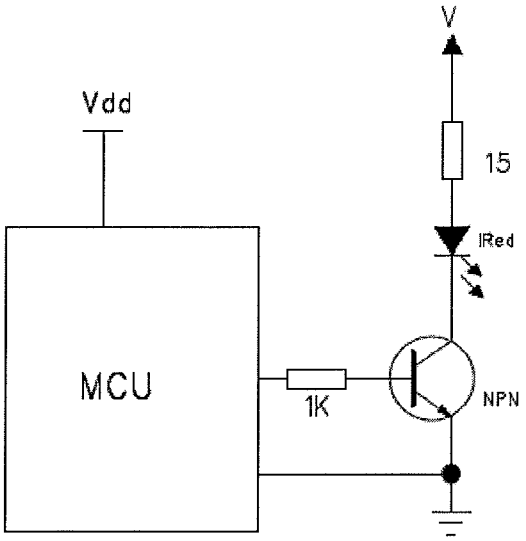

FIG. 6*a* shows the circuit for driving IRED.

Figure 6B:
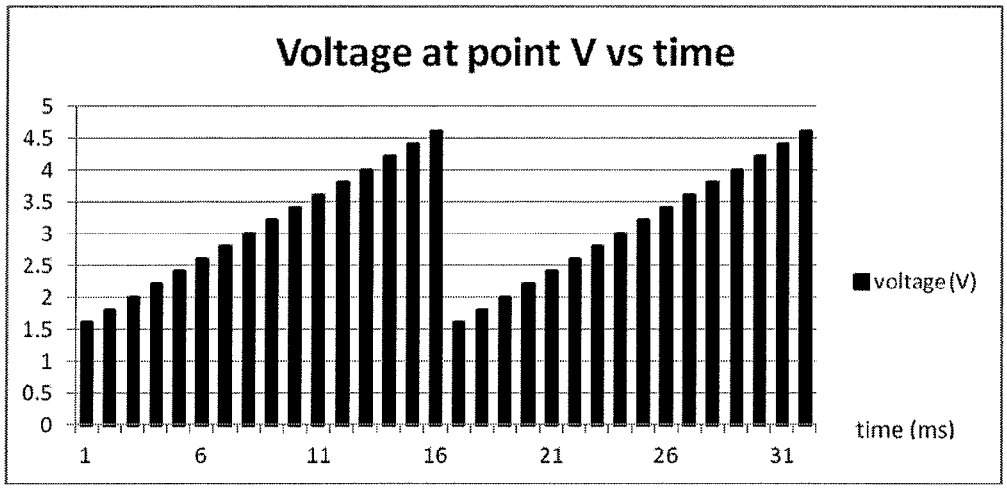

FIG. 6*b* shows the voltage supply across the IRED driving circuit vs time by assuming Imax=16.

Figure 7:
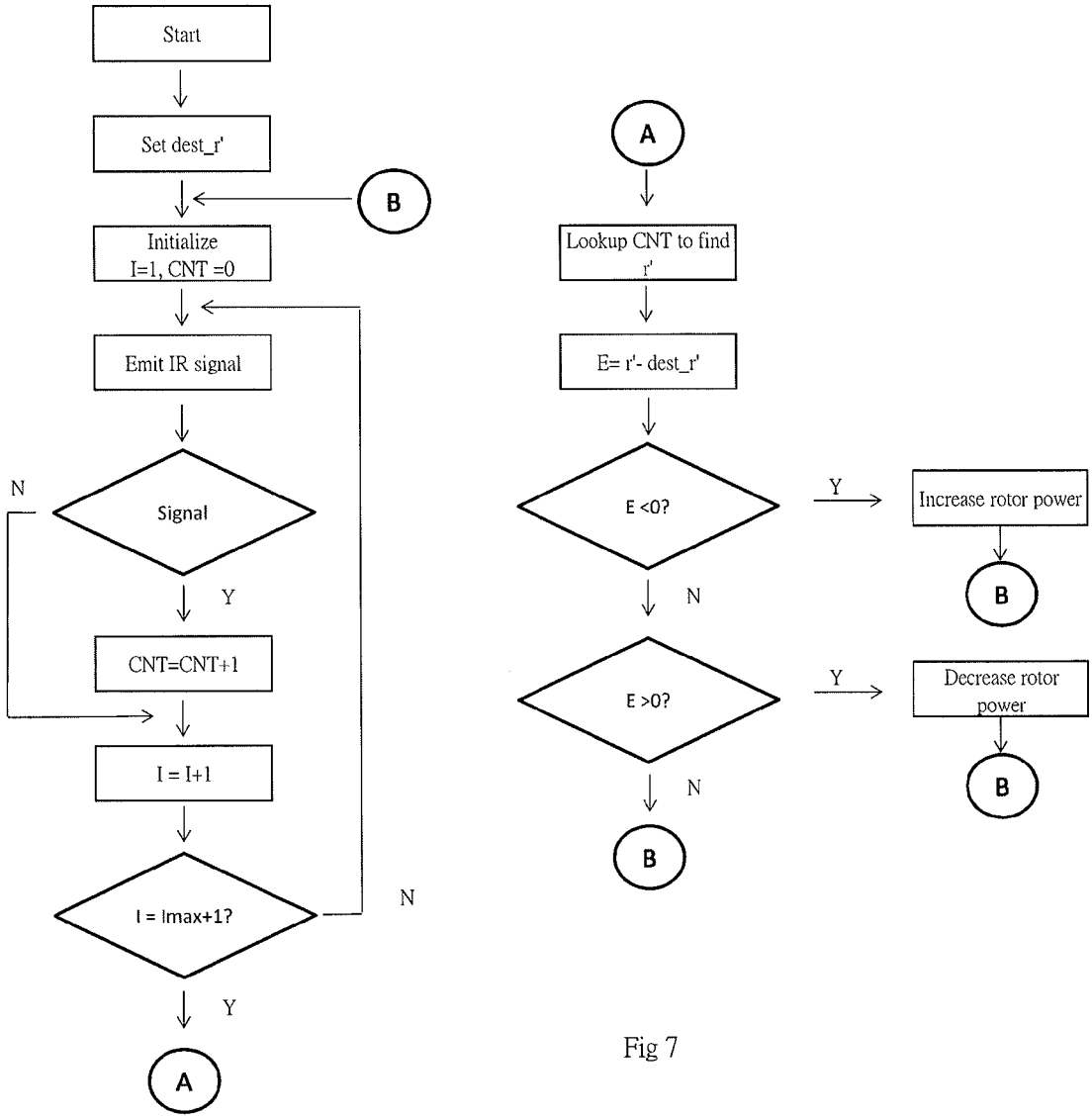

FIG. 7 is a flow chart of altitude hold control method.

Figure 8:
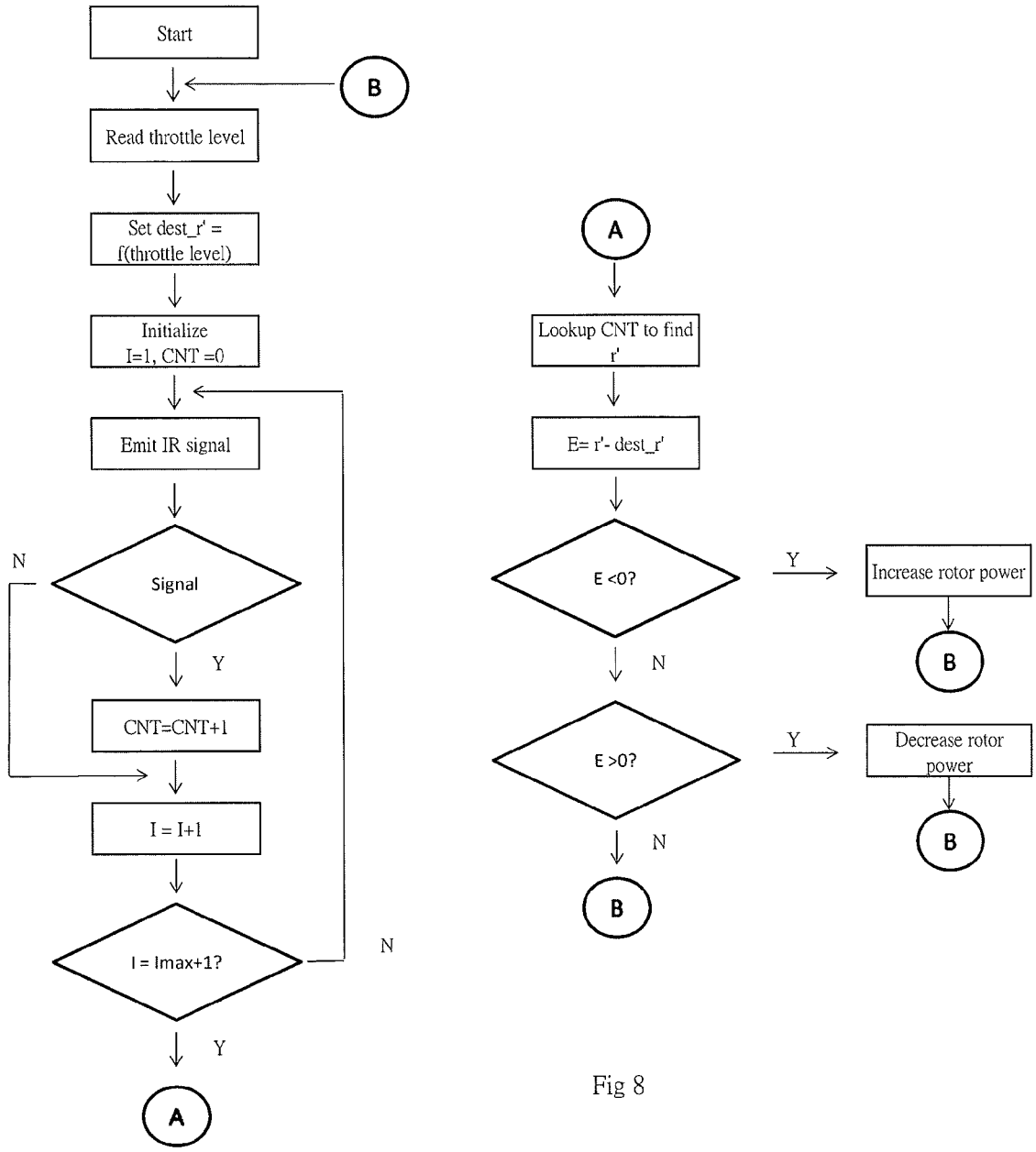

FIG. 8 is a flow chart of selectable altitude hold control method.

Figure 9:
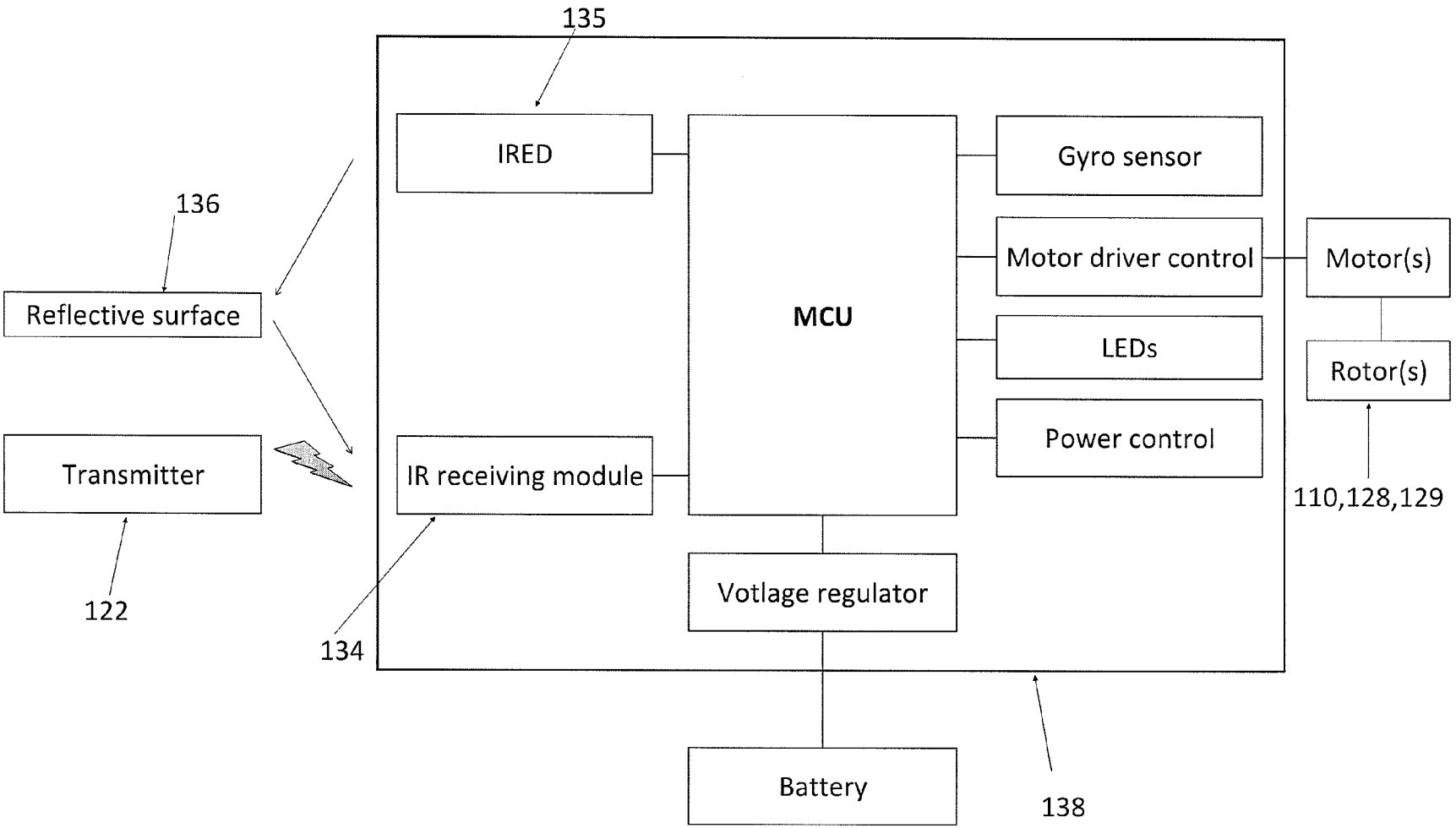

FIG. 9 is the block diagram of the electronic components.

Figure 10:
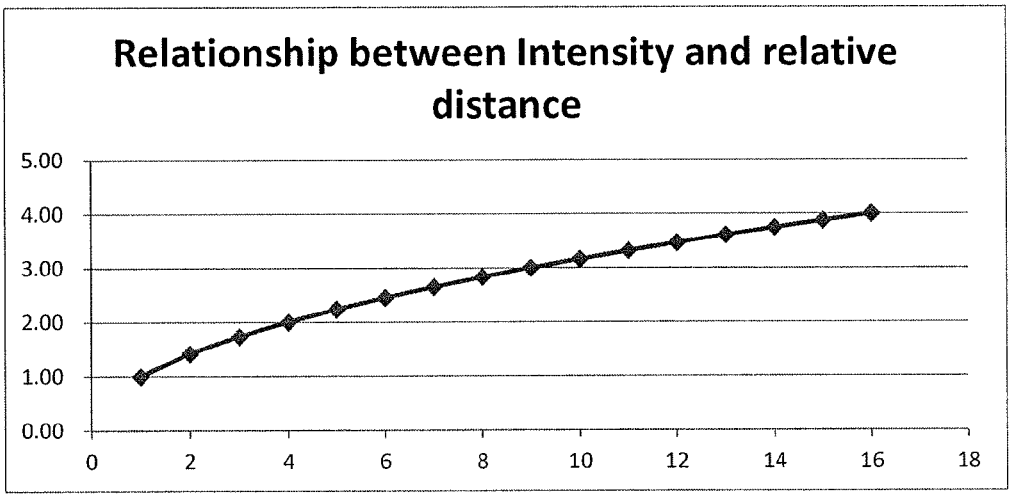

FIG. 10 is a graph relating intensity to distance.

Figure 11:
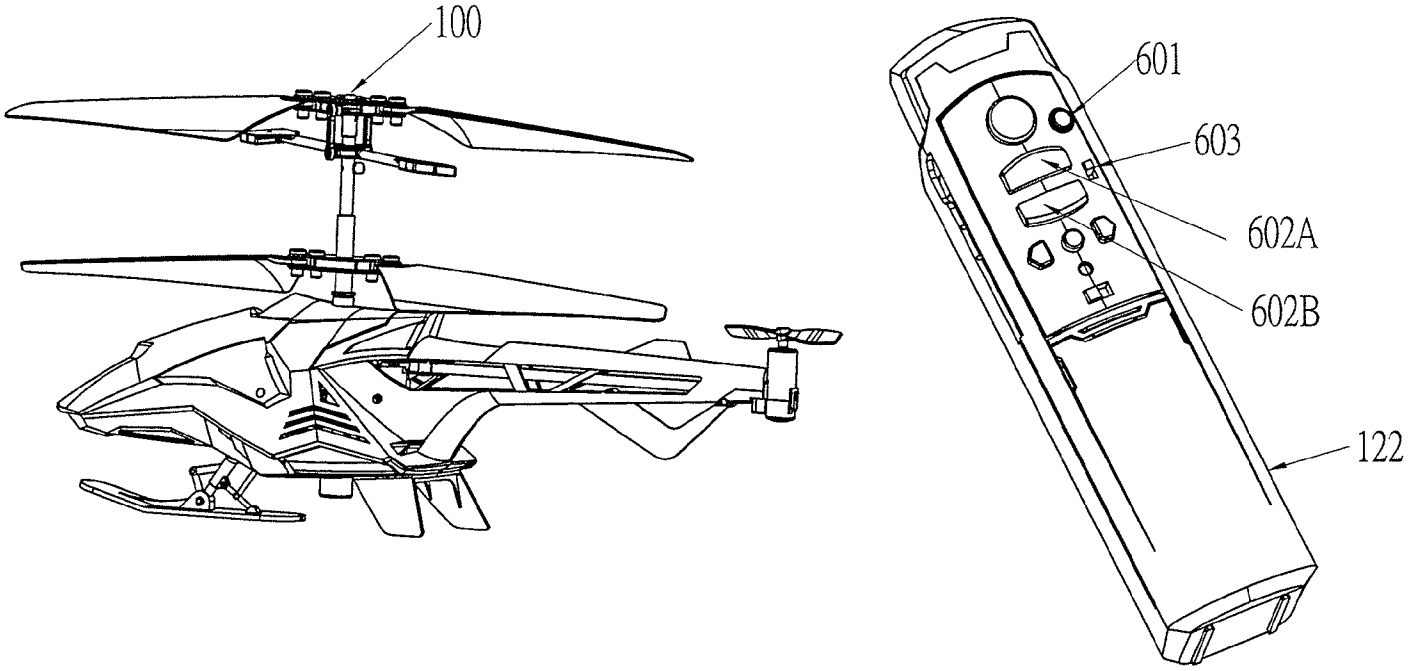

FIG. 11 is perspective view of a helicopter and a gesture control transmitter.

Figure 12:
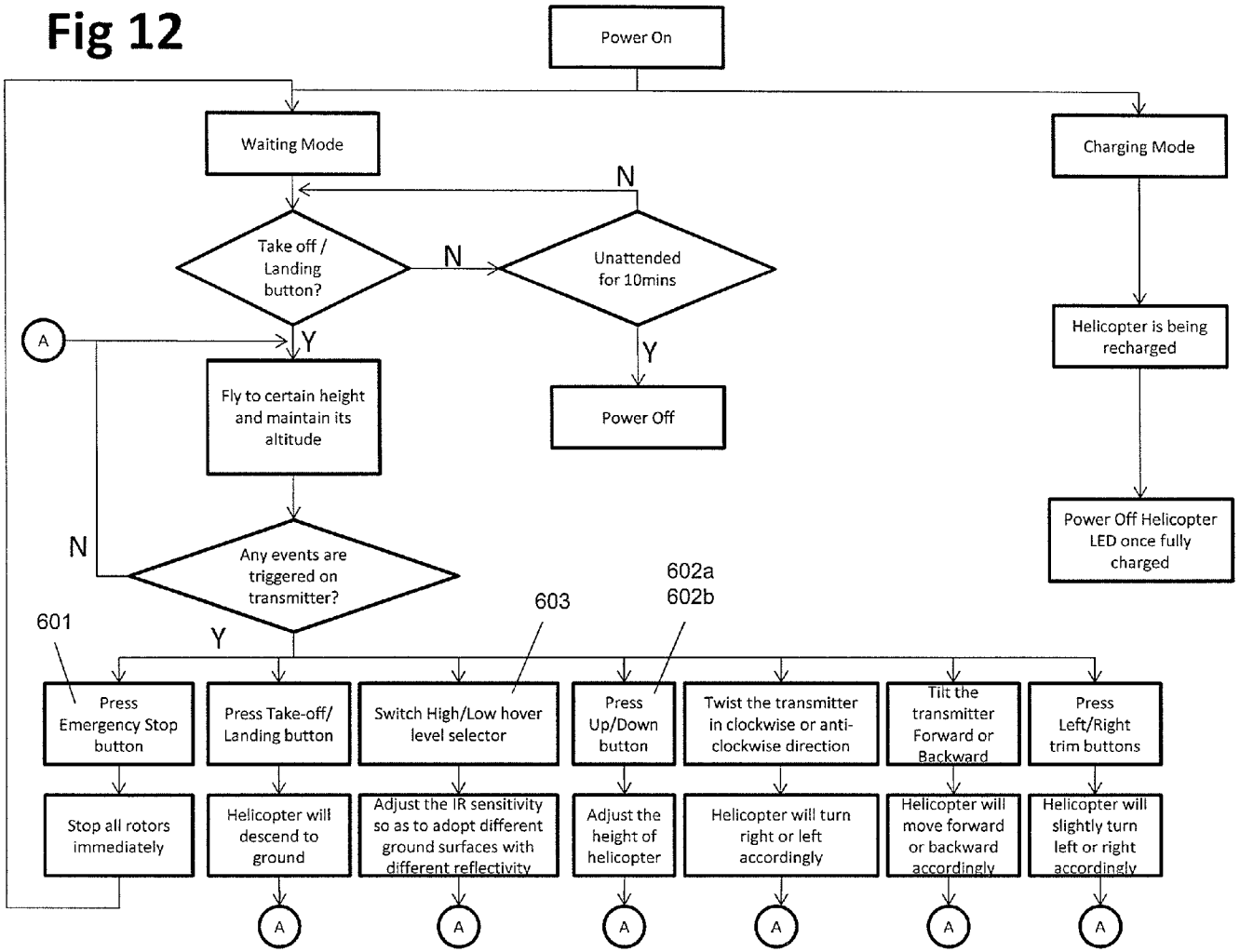

FIG. 12 is a flow chart to show the control method between the gesture control transmitter and helicopter.

Figure 13:
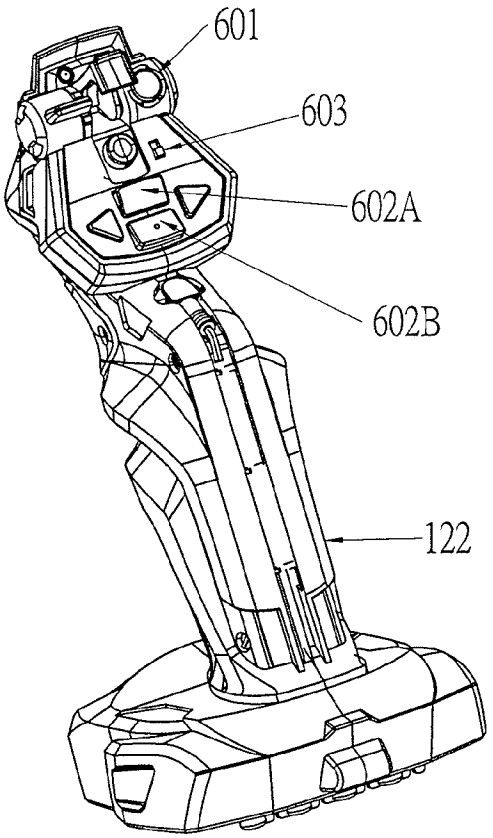
Figure 13:
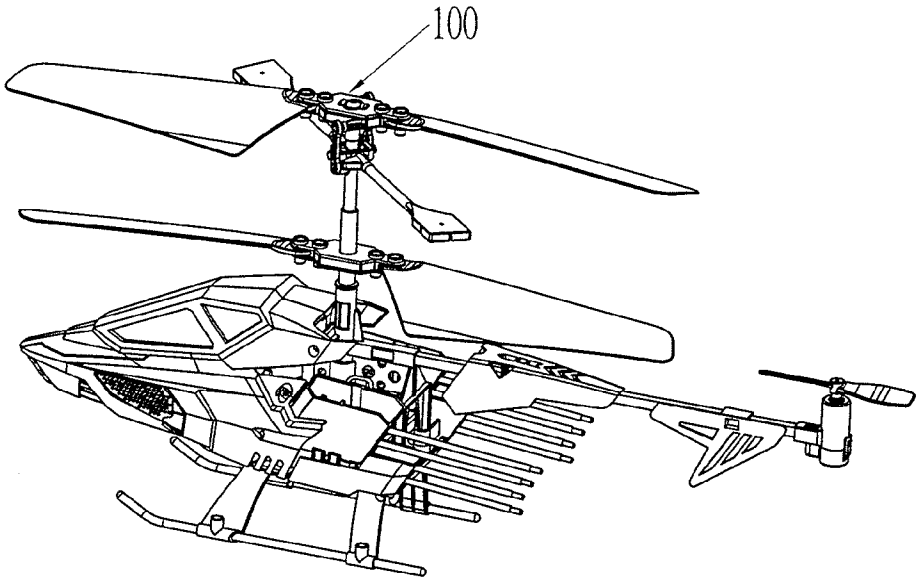

FIG. 13 is perspective view of a helicopter and another type of gesture control transmitter.

Figure 14:
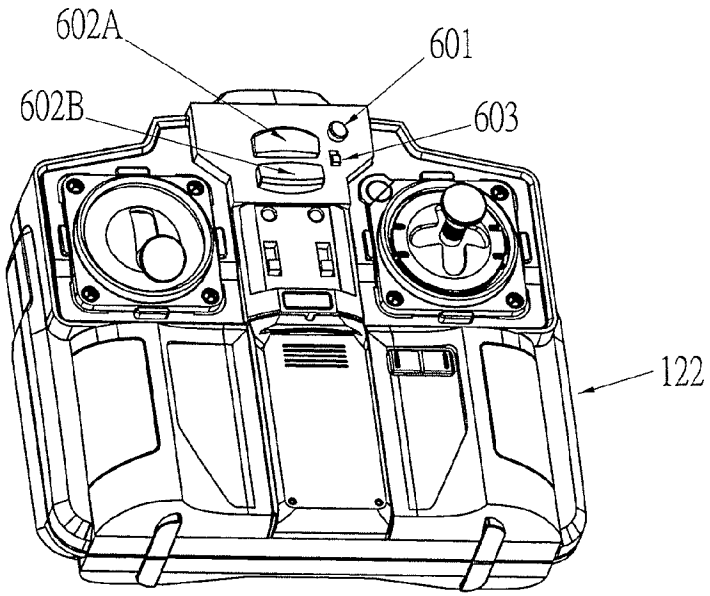

FIG. 14 is perspective view of a full function transmitter.

DETAILED DESCRIPTION

The disclosure is capable of being implemented in embodiments in many different forms. There are shown in the drawings and will be described herein, in detail, some of the embodiments of the present disclosure. The present disclosure is to be considered an exemplification of the principles of the disclosure and is not intended to limit the spirit or scope of the disclosure and/or the embodiments illustrated.

The disclosure is directed to a method of controlling a flying toy such as helicopter, the system for affecting this control and the toy which is operable in this manner.

A method of remote controlling an altitude of a toy flying vehicle intended for indoor operation, the vehicle having a rotor for rotation relative to a fuselage of the vehicle, and a separate remote controller for use by a player of the toy comprises providing a selected altitude level for the vehicle.

A position control signal is transmitted from the vehicle towards a surface. A receiver in the vehicle is provided for the signal reflected from the surface.

A level of the reflected signal by the receiver is determined, and a change of the reflected signal being an indicator of a change of altitude of the vehicle relative to the selected altitude level. The rotor action is adjusted in response to a change of the altitude level thereby to retain the selected altitude level.

The selected level can be a range between an upper and a lower level. Alternatively the level is a substantially constant altitude.

Adjusting the rotor action is to a lower the speed to lower the vehicle to the selected altitude level or to increase the speed to raise the vehicle to the selected altitude level.

There is a receiver the vehicle for communication with the remote controller, the remote controller being capable of adjusting and controlling speed and direction of the vehicle.

The position control signal is directed upwardly thereby to retain the altitude relative to surface located above the vehicle. The surface from which the signal is reflected is passive indoor surface without a signal generator feature apart from the reflection of the position control signal. Thus there is no active emitter on the surface, and signal bounces off a wall or ceiling or floor which is the normal structure of an indoor environment. Thus use of the toy does not require anything other than the flying toy itself and the remote controller for the player.

The position control signal is directed downwardly thereby to retain the altitude relative to surface located below the vehicle.

Also there is a position control signal directed transversely relative to the vehicle thereby to reflective from a transversely located surface relative to the vehicle thereby to retain the distance of the vehicle relative to the transversely located surface.

There can be multiple position control signal directed transversely in multiple respective directions relative to the vehicle thereby to reflective from multiple transversely located surfaces relative to the vehicle. This permits the vehicle to retain its distance relative to the multiple transversely located surfaces, and thereby maintain the vehicle at a selected distance relative to the transverse surfaces.

The multiple position control signals are directed relatively transversely, forwardly and sideways of the vehicle.

There can be multiple position control signals directed transversely in multiple respective directions relative to the vehicle thereby to reflective from multiple transversely located surfaces relative to the vehicle. This retains the distance of the vehicle relative to the multiple transversely located surfaces. The multiple position control signals are directed relatively transversely, forwardly and sideways of the vehicle. This maintains the vehicle at a selected distance relative to the transverse surfaces. The signals are directed upwardly and downwardly from the vehicle thereby to maintain the altitude of the vehicle.

A desired selected level of reflected position control signal is defined in at least one receiver in the vehicle. The action of the rotor is dependent on variation from a designated position, as determined by a difference in the received reflected position control signal.

Respective desired selected levels of reflected position control signals can be defined in multiple respective receivers in the vehicle, the respective multiple receivers being directed in respective different directions and there being multiple respective position signals directed in mating respective directions relative the respective receivers. The action of the rotor is dependent on variation from designated positions, as determined by a difference in the received reflected position control signals.

Controlling the toy can be by controls selected from at least one of a stop control; an altitude control by at least one of an up control; down control; a high height sensitivity control and a low height sensitivity control. Each one of these or more of these controls can have different degrees of sensitivity. Thus for instance the control of the up control or down control can have a more or a less sensitive reaction to the control button or buttons. Thus when the flying toy is closer to a ceiling or loser to floor the control for height may be more quickly reactive than when the toy is further from those barriers. Appropriate control programs are established for each of these controls protocols.

The flying toy thereby seeks to limit the maximum height thereby to receive at least one reflected signal. Controlling rotor power can be by current speed of rotor at a time (t) determines by previous speed at a time (t−1), and a battery level in the flying toy.

The level of the reflected signal is a digital measure, whereby the receiver will level whether received or not received and not an intensity of the received the signal.

The receiver the vehicle receives throttle and direction control command from the remote controller.

In one form the method of remote controlling an altitude of a toy flying vehicle intended for indoor hovering flight, the vehicle having a rotor for rotation relative to a fuselage of the vehicle, and a separate remote controller for use by a player of the toy comprises providing a selected altitude level for the vehicle. A position control signal from the vehicle towards a surface. A receiver is provided in the vehicle for the signal reflected from the surface. A level of the reflected signal by the receiver, a change of the reflected signal being an indicator of a change of altitude of the vehicle relative to the selected altitude level.

The rotor action is adjusted in response to a change of the altitude level thereby to retain the selected altitude level; wherein the level is a substantially constant altitude.

The vehicle is also in communication with the remote controller, the remote controller being capable of adjusting and controlling speed and direction of the vehicle. The receiver in the vehicle is responsive to signals with the remote controller, and the signals from the remote controller are for changing speed and direction of the hovering toy.

There is provided a method of remote controlling an altitude of a toy flying vehicle intended for indoor hovering flight, the vehicle having a rotor for rotation relative to a fuselage of the vehicle.

There is a separate remote controller for use by a player of the toy.

The system comprises providing a selected altitude level for the vehicle. A position control signal is transmitted from the vehicle towards a surface. A receiver in the vehicle receives the signal reflected from the surface. A level of the reflected signal by the receiver is determined, and a change of the reflected signal is an indicator of a change of altitude of the vehicle relative to the selected altitude level.

The vehicle receiver communicates with the remote controller, and the remote controller can adjust and control speed and direction of the vehicle.

The receiver in the vehicle is responsive to signals with the remote controller, the signals from the remote controller being for changing speed, and also the direction of the hovering toy.

The position control signal is directed upwardly thereby to retain the altitude relative to surface located above the vehicle, wherein the surface from which the signal is reflected is passive indoor surface without a signal generator feature apart from the reflection of the position control signal. There is an additional position control signal directed relative to the vehicle thereby to reflective from an additional located surface relative to the vehicle thereby to retain the distance of the vehicle relative to the additional located surface.

While the disclosure is susceptible to embodiments in many different forms, there are shown in the drawings and will be described herein, in detail, the preferred embodiments of the present disclosure. It should be understood, however, that the present disclosure is to be considered an exemplification of the principles of the disclosure and is not intended to limit the spirit or scope of the disclosure and/or the embodiments illustrated.

A toy vehicle 100 is for indoor use and is provided with a system to control the height or distance of the vehicle away from a surface or another object. The vehicle 100 includes a rotor 110 to propel the vehicle 100 in a specified direction. There is a fuselage or body 120.

Figure 1:
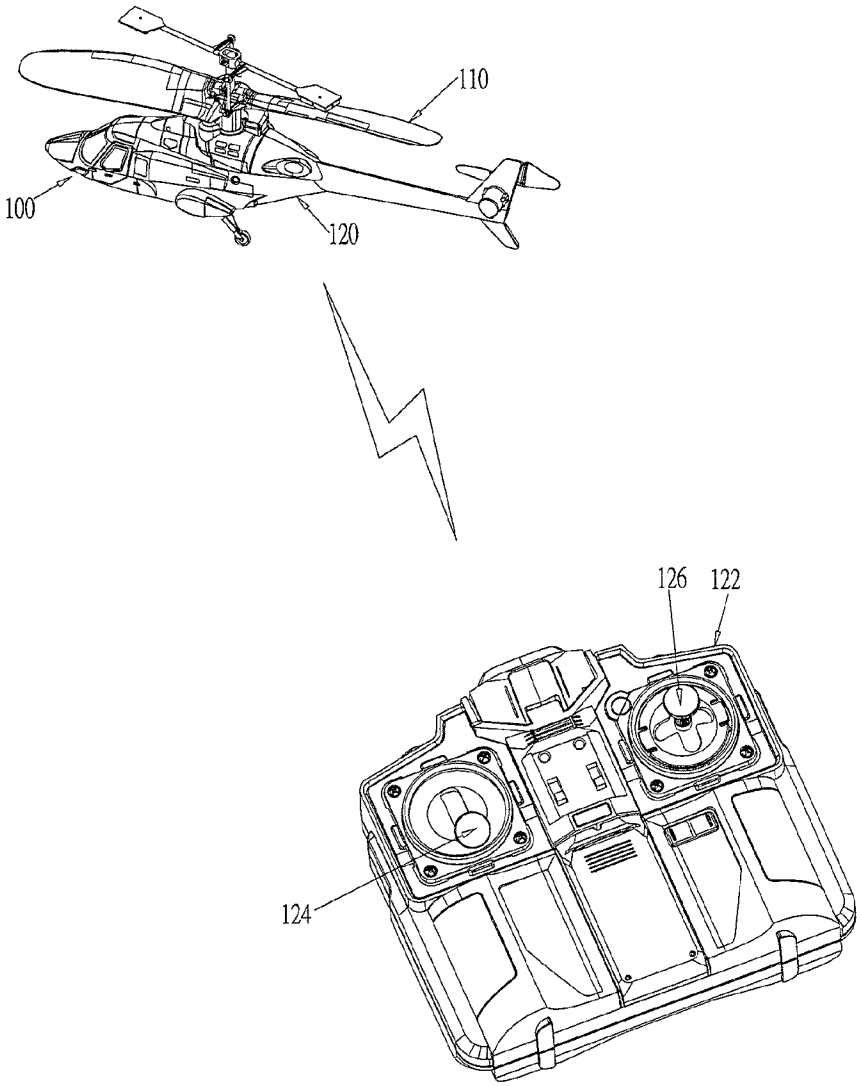
Figure 2A:
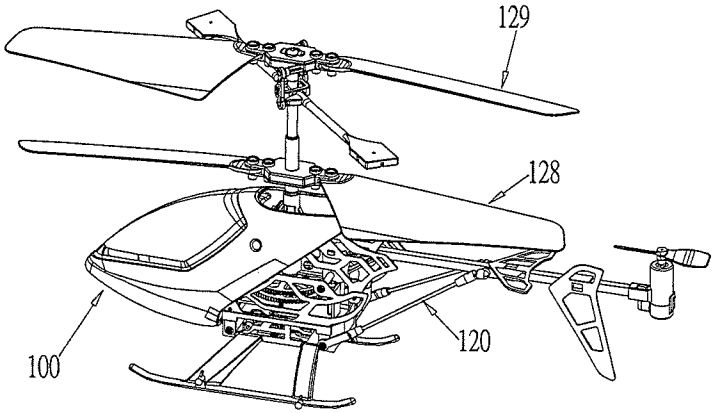
Figure 2B:
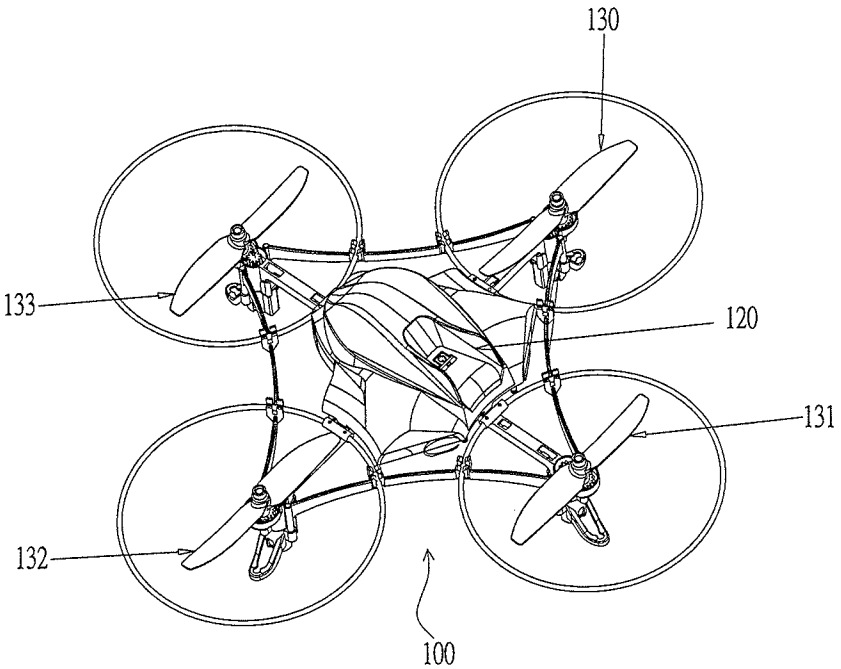
Figure 3:
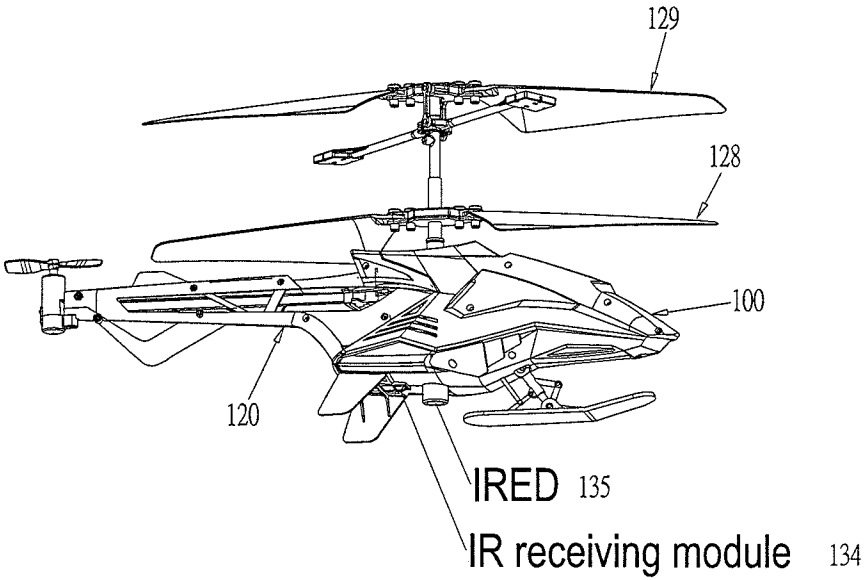
FIG. 3 is a perspective view of a helicopter for showing the IRED and IR receiving module.
Figure 4:
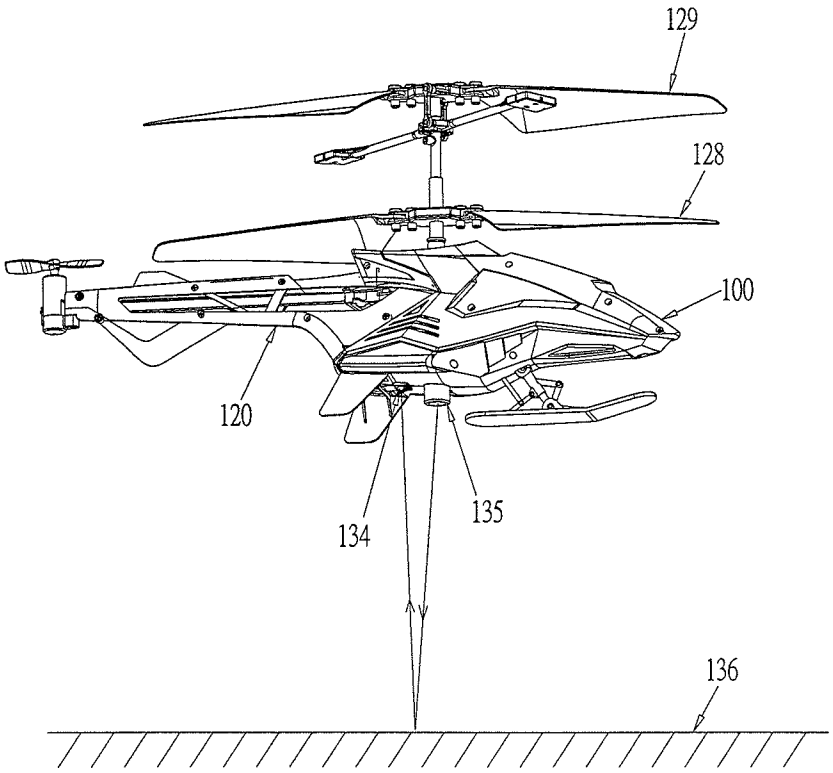
FIG. 4 is a perspective view of the present disclosure showing the helicopter hovering with altitude hold control.

In FIG. 1 there is a single rotor system for hovering toy, namely a helicopter, and there is show a remote controller transmitter 122 with toggles 124 and 126 for controlling speed and direction of the vehicle 100. In FIGS. 2*a*, 3, 4, 5*a* and 5*b* there is show a helicopter with counter rotating rotors 128 and 129. In FIG. 2*b* there is shown hovering flying toy with four spaced rotors 130, 131, 132 and 133 located about the body 120.

There is a control system and a battery power supply for the hovering toy. The control system includes the remote controller transmitter 122 and a receiver 134 in the body 120 which is in wireless communication with an IR receiving module on a circuit board 138 which is further in communication with and control of the rotor 110. The transmitter 122 and receiver 134 pair is preferably an infra-red pair, however other transmitter/receiver pairs or communication protocols may be used and may be incorporated.

There is IRED cell 135 which generates a signal to a reflective surface 136 which in turn reflects or bounces the signal back to the receiving module 134. This signal, together with any signals from the transmitter 122, is processed by the microprocessor circuit MCU. The MCU in turn is powered by the battery through a voltage regulator. The MCU controls the Gyro sensor, motor driver control, LEDs and the power control of the hovering vehicle. The motor drive control controls one or more motors to control one or more rotors respectively.

The control method of the transmitter is not limited to Infrared. It can be a radio frequency such as 27 MHz, 40 MHz, 49 MHz or 2.4 GHz, or be Bluetooth or WiFi.

The increment of light intensity I is not necessary to be increased linearly, it can square of I .i.e $I=1^2, 2^2, 3^2, \ldots, n^2$ or it can be in the sequence of light intensity decrement.

By putting the IRED and IR receiving module on top of flying toy and applying present IR distance measurement method, it can be used to perform an altitude hold fight with reference to ceiling of a room rather than ground surface. (FIG. 5*a*).

Similarly, it can be used to detect the distance between the flying toy and obstacles, objects or surfaces around it. By changing the direction of flight rather than moving upward or down as in present disclosure, it can act as obstacle avoidance control (FIG. 5*b*)

There can be a flying toy having plurality of rotors, infrared emitting diode (IRED) and IR receiving module. This module can be used to receive the signal from transmitter and the signal from the IRED itself. In physics, the intensity or brightness of light as a function of the distance from the light source follows an inverse square relationship. For a given reflecting ground upper or transverse surface and given sensitivity of IR receiving module, the relationship between light intensity and distance can be obtained.

Because of using light reflection method, the maximum height can be measured is limited to less than about 3 meters.

The IR signal is usually modulated to around 30~40 kHz for transmission while IR receiving module can filter the noise out of these frequency range and demodulate the signal for MCU decoding. The intensity of IR light that an IRED produces is directly proportional to the current. By controlling different levels of voltage supply and hence current to IRED, different light intensity can be obtained.

Suppose IR intensity is denoted by I and there are Imax intensity levels from 1, 2, . . . Imax. Also, the sensitivity of IR receiving module is denoted by S, then the distance r is calculated by inverse square equation $$r = K\sqrt{\frac{I}{S}}$$

where K is the characteristics of reflecting surface. K is large for regular reflection, i.e., when a beam pass of parallel light rays is incident on a smooth and plane surface such as marble, mirror, gloss or white surface. K is small for irregular reflection. i.e., when a beam of parallel light rays is scattered in all directions. Therefore the parallel rays incident on the surface, such as carpet, coarse or black surface, will reflect in different directions.

Assume K remains unchanged within the same reflecting surface and S is the constant for a given IR receiving module, the equation can be simplified to $r=K'\sqrt{I}$ Since K' is unknown unless measurement is carried out on corresponding reflecting surface, relative distance r' instead of absolute distance can be calculated. Equation becomes $$r' = \frac{r}{K'} = \sqrt{I}$$

The table and graph below show the relationship between light intensity and relative distance r'

| Light intensity from IRED (I) | Relative distance from ground (r') | No of signals received (CNT) |
|---|---|---|
| 1 | 1.00 | 16 |
| 2 | 1.41 | 15 |
| 3 | 1.73 | 14 |
| 4 | 2.00 | 13 |
| 5 | 2.24 | 12 |
| 6 | 2.45 | 11 |
| 7 | 2.65 | 10 |
| 8 | 2.83 | 9 |
| 9 | 3.00 | 8 |
| 10 | 3.16 | 7 |
| 11 | 3.32 | 6 |
| 12 | 3.46 | 5 |
| 13 | 3.61 | 4 |
| 14 | 3.74 | 3 |
| 15 | 3.87 | 2 |
| 16 | 4.00 | 1 |
| . . . | . . . | . . . |
| Imax | $\sqrt{Imax}$ | Imax + 1 − 1 |

The altitude hold control method comprising of:

Setting the relative destination distance dest_r' from ground to be achieved.

Initialize the light intensity I=1 and no of signals received CNT=0.

Emitting IR signal with light intensity I to the ground surface within the period of time between 0.4 ms to 500 ms.

Step increment of CNT if this IR signal is received by IR receiving module. i.e CNT=CNT+1.

Step increment of light intensity i.e. I=I+1.

Repeating steps as illustrated in FIG. 7.

According to the inverse-square law, no of IR signals received depend on the altitude of flying toy and the signal intensity. For a given r', those signals with higher intensity can be reflected from the ground surface to IR receiving module.

If r'=1, all IR signals can be received. i.e CNT=Imax. If r'=1.41, only IR signals with intensity at I=2 or above can be received, i.e. CNT=Imax−1. Similarly, if r'=1.73, only IR signals with intensity at I=3 or above can be received, i.e. CNT=Imax−2. In general CNT=Imax+1−I.

As CNT is known, relative distance r' can be obtained from table.

Calculate the error E=r'−dest_r'.

If E is negative, i.e. the current altitude of the flying toy is lower than the destination altitude, at least one of the rotors will increase the power for flying upward in which the power increment is proportional to E. Repeat steps as illustrated in FIG. 7.

If E is positive, i.e. the current altitude of the flying toy is higher than the destination altitude, at least one of the rotors will decrease the power for flying downward in which the power decrement is proportional to E. Repeat steps as illustrated in FIG. 7.

If E is zero or approximate zero, i.e. the current altitude of the flying toy is same as destination altitude, the power of rotors remains unchanged. Repeat steps as illustrated in FIG. 7.

To further allow user selecting desire altitude of a flying toy, throttle level can be read and set the relative destination distance accordingly.

Selectable altitude hold control method comprising of:

Reading the throttle level from transmitter.

Setting the relative destination distance dest_r' from ground according to the throttle level.

Initialize the light intensity I=1 and no of signals received CNT=0.

Emitting IR signal with light intensity I to the ground surface within the period of time between 0.4 ms to 500 ms.

Step increment of CNT if this IR signal is received by IR receiving module. i.e CNT=CNT+1.

Step increment of light intensity i.e. I=I+1.

Repeating steps as illustrated in FIG. 8.

According to the inverse-square law, no of IR signals received depend on the altitude of flying toy and the signal intensity. For a given r', those signals with higher intensity can be reflected from the ground surface to IR receiving module.

If r'=1, all IR signals can be received. i.e. CNT=Imax. If r'=1.41, only IR signals with intensity at I=2 or above can be received, i.e. CNT=Imax−1. Similarly, if r'=1.73, only IR signals with intensity at I=3 or above can be received, i.e. CNT=Imax−2. In general CNT=Imax+1−I.

As CNT is known, relative distance r' can be obtained from table.

Calculate the error E=r'−dest_r'.

If E is negative, i.e. the current altitude of the flying toy is lower than the destination altitude, at least one of the rotors will increase the power for flying upward in which the power increment is proportional to E. Repeat steps as illustrated in FIG. 8.

If E is positive, i.e. the current altitude of the flying toy is higher than the destination altitude, at least one of the rotors will decrease the power for flying downward in which the power decrement is proportional to E. Repeat steps as illustrated in FIG. 8.

If E is zero or approximate zero, i.e. the current altitude of the flying toy is same as destination altitude; the power of rotors remains unchanged. Repeat steps as illustrated in FIG. 8.

In FIGS. 11 to 14 the components are 100: Helicopter; 122: Transmitter; 601: Emergency stop button; 602*a*: Up button; 602*b*: Down button and 603: Hi/Li sensitivity switch.

The apparatus, device, toy, system and method of operation includes take-off/landing buttons and controls; gesture mode control; and Left/Right trim buttons or controls. The use of any of the function buttons can activate special features. It is possible to switch the control method between altitude control mode and manual control mode. The different control processes are illustrated in the flow diagram of FIG. 12.

As illustrated in FIG. 11, apart from and in addition to a control buttons/switch, this transmitter also includes:

1. Take-off/landing button in which the flying toy can start the motor and fly to certain height automatically after pressing this button. By pressing this button again, the flying toy can descend gradually until it reaches ground level.

2. Gesture mode control in which player can tilt the transmitter forward and backward so that the flying toy follows both direction and speed in proportional to its tilt angle. Similarly, player can twist the transmitter in clockwise or anti-clockwise direction so that the flying toy can make a right or left turn in proportional to its twist angle 3. Left and right trim buttons in which player can align the flying toy for flying straight.

As illustrated in FIG. 13, apart from and in addition to a control buttons/switch, this transmitter also includes:

1. Take-off/landing button in which the flying toy can start the motor and fly to certain height automatically after pressing this button. By pressing this button again, the flying toy can descend gradually until it reaches ground level.

2. Gesture mode control in which player can tilt the transmitter forward, backward, leftward or rightward so that the flying toy follows both direction and speed in proportional to its tilt angle.

3. Left and right trim buttons in which player can align the flying toy for flying straight.

4. At least one function button which can be used to activate one or more special feature on flying toy such as headlight, shooting missile(s), taking photos or driving an actuator such as motor, solenoid, or Shape Memory Alloy/Polymer etc.

As illustrated in FIG. 14, apart from and in addition to a control buttons/switch, this transmitter also includes:

1. Take-off/landing button in which the flying toy can start the motor and fly to certain height automatically after pressing this button. By pressing this button again, the flying toy can descend gradually until it reaches ground level.

2. One or more control sticks for controlling throttle, forward, backward, left turn, right turn, leftward fly and rightward fly. In manual control mode, altitude control function is masked.

3. Left and right trim buttons in which player can align the flying toy for flying straight.

4. At least one function button which can be used to activate one or more special feature on flying toy such as headlight, shooting missile(s), taking photos or driving an actuator such as motor, solenoid, or Shape Memory Alloy/Polymer etc.

5. A button or selector which can switch the control method from manual mode to altitude control mode.

6. An operation procedure in control stick, mainly throttle stick, which can switch the control method from altitude control mode back to manual mode.

This operation procedure further comprises of a. While the flying toy is in altitude control mode, release the throttle stick so that this stick returns to neutral position by a spring. This action does not affect the hovering height of flying toy b. Push the throttle stick slowly until the throttle step is greater than or equal to current motor speed to take over the control method from altitude control to manual control mode.

c. Indication on flying toy and/or transmitter for swapping the control method from altitude control to manual control mode.

An alternative operation procedure comprises of a. While the flying toy is in altitude control mode, push the throttle stick from any region to the central region i.e. around 50% throttle b. Keep the throttle stick in this region unchanged for a certain period of time, says more than 1 sec.

c. Push the throttle stick either up or down slower to take over the control method from altitude control to manual control mode.

d. Indication on flying toy and/or transmitter for swapping the control mode from altitude control to manual control mode.

The apparatus and method have been described in terms of what are presently considered to be the most practical and preferred embodiments, it is to be understood that the disclosure need not be limited to the disclosed embodiments.

It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A method of remote controlling an altitude of a toy flying vehicle intended for indoor operation, the vehicle having a rotor for rotation relative to a fuselage of the vehicle, and a separate remote controller for use by a player of the toy, the method comprising:

(a) providing a relative selected altitude level r'd corresponding to a selected altitude for the vehicle;

(b) transmitting a position control signal with a light intensity I from the vehicle towards a surface;

(c) determining if a reflected signal of said position control signal is received from the surface;

(d) increasing a counter CNT if said reflected signal is received;

(e) increasing said light intensity I;

(f) repeating steps (b)-(e) while said light intensity I is less than a maximum value;

(g) determining a relative altitude r' and adjusting rotor action according to a difference between the relative altitude r' and the relative selected altitude level r'd to retain the selected altitude, wherein said determining the relative altitude r' comprises selecting the relative altitude r' from a table comprising correlations between values for the relative altitude r' and values for the counter CNT; and controlling the toy by a control selected from at least one of a stop control; an altitude control by at least one of an up control; down control; a high height sensitivity control and a low height sensitivity control; take-off/landing control; gesture mode control; left/right trim control; control between altitude control mode and manual control mode.

2. A method as claimed in claim 1 wherein the selected altitude is a range between an upper and a lower level.

3. A method as claimed in claim 1 wherein the selected altitude is a substantially constant altitude.

4. A method as claimed in claim 1 wherein adjusting the rotor action is to lower the speed to lower the vehicle to the selected altitude or to increase the speed to raise the vehicle to the selected altitude.

5. A method as claimed in claim 1 wherein the vehicle includes a receiver for communication with the remote controller, the remote controller being capable of adjusting and controlling speed and direction of the vehicle.

6. A method as claimed in claim 1 wherein the position control signal is directed upwardly thereby to retain the selected altitude relative to a surface located above the vehicle.

7. A method as claimed in claim 1 wherein the surface from which the signal is reflected is passive indoor surface.

8. A method as claimed in claim 1 wherein the position control signal is directed downwardly thereby to retain the selected altitude relative to surface located below the vehicle.

9. A method as claimed in claim 1 further including transmitting a position control signal directed transversely relative to the vehicle thereby to reflect from a transversely located surface relative to the vehicle thereby to retain a distance of the vehicle relative to the transversely located surface.

10. A method as claimed in claim 1 further including transmitting multiple position control signals directed transversely in multiple respective directions relative to the vehicle thereby to reflect from multiple transversely located surfaces relative to the vehicle thereby to determine one or more respective relative distances of the vehicle to the multiple transversely located surfaces, and thereby maintain the vehicle at one or more respective selected distances to the transverse surfaces.

11. A method as claimed in claim 10 wherein the multiple position control signals are directed relatively transversely, forwardly and sideways of the vehicle.

12. A method as claimed in claim 1 including multiple position control signal directed transversely in multiple respective directions relative to the vehicle thereby to reflect from multiple transversely located surfaces relative to the vehicle thereby to determine one or more respective relative distances of the vehicle to the multiple transversely located surfaces, wherein the multiple position control signals are directed relatively transversely, forwardly and sideways of the vehicle, and thereby maintain the vehicle at one or more respective selected distances to the transverse surfaces, and including signals directed upwardly and downwardly from the vehicle thereby to maintain the selected altitude of the vehicle.

13. A method as claimed in claim 1 further including defining a desired selected level of reflected position control signal in at least one receiver in the vehicle, and wherein the action of the rotor is dependent on variation from a designated position, as determined by a difference in the received reflected position control signal.

14. A method as claimed in claim 1 including defining respective desired selected levels of reflected position control signals in multiple respective receivers in the vehicle, the respective multiple receivers being directed in respective different directions and there being multiple respective position signals directed in mating respective directions relative the respective receivers, and wherein the action of the rotor is dependent on at least one variation from at least one designated position, as determined by at least one difference in the received reflected position control signals.

15. A method as claimed in claim 1 wherein the vehicle is configured to limit the maximum height thereby to receive at least one reflected signal.

16. A method as claimed in claim 1 including controlling rotor power by current speed of the-rotor at a time (t) determined by a previous speed at a time (t−1), and a battery level in the vehicle.

17. A method as claimed in claim 1 wherein the level of the reflected signal is a received digital measure and not an intensity of the received signal.

18. A method as claimed in claim 1 wherein the vehicle comprises a receiver to receive throttle and direction control commands from the remote controller.

19. A method as claimed in claim 1 wherein adjusting the rotor action according to a difference between the relative altitude r' and the relative selected altitude level r'd comprises calculating an error, $E=r'-r'd$, wherein if E is negative, representing a current altitude of the vehicle as lower than the selected altitude, the rotor increases the power for flying upward in which the power increment is proportional to E;

wherein if E is positive, representing a current altitude of the vehicle is higher than the selected altitude, the rotor decreases the power for flying downward in which the power decrement is proportional to E, and wherein if E is zero or approximate zero, representing the current altitude of the vehicle is same as the selected altitude, the power of the rotor remains unchanged.

20. A method as claimed in claim 1 wherein the selected altitude is set by setting a throttle level from a transmitter.

21. A method of remote controlling an altitude of a toy flying vehicle intended for indoor hovering flight, the vehicle having a rotor for rotation relative to a fuselage of the vehicle, and a separate remote controller for use by a player of the toy comprising:

(a) providing a relative selected altitude level r'd corresponding to a selected altitude for the vehicle;

(b) transmitting a position control signal with a light intensity I from the vehicle towards a surface;

(c) determining if a reflected signal of said position control signal is received from the surface;

(d) increasing a counter CNT if said reflected signal is received;

(e) increasing said light intensity I;

(f) repeating steps (b)-(e) while said light intensity I is less than a maximum value;

(g) determining a relative altitude r' and adjusting the rotor action according to a difference between the relative altitude r' and the relative selected altitude level r'd to retain the selected altitude, wherein said determining the relative altitude r' comprises selecting the relative altitude r' from a table comprising correlations between values for the relative altitude r' and values for the counter CNT;

(h) performing steps (a)-(g) for an additional position control signal directed relative to the vehicle thereby to reflect from an additional located surface relative to the vehicle thereby to retain the distance of the vehicle relative to the additional located surface;

the vehicle being configured for communication with the remote controller, the remote controller being capable of adjusting and controlling speed and direction of the vehicle and a receiver in the vehicle being responsive to signals with the remote controller, the signals from the remote controller being for changing speed and direction of the vehicle, and wherein the position control signal is directed upwardly thereby to retain the selected altitude relative to surface located above the vehicle, and wherein the surface from which the signal is reflected is a passive indoor surface; and controlling the toy by a control selected from at least one of a stop control; an altitude control by at least one of an up control; down control; a high height sensitivity control and a low height sensitivity control; take-off/landing control; gesture mode control; left/right trim control; control between altitude control mode and manual control mode.

22. A method as claimed in claim 21 wherein adjusting the rotor action according to a difference between the relative altitude r' and the relative selected altitude level r'd comprises calculating an error, E=r'−r'd, wherein if E is negative, representing a current altitude of the vehicle as lower than the selected altitude, the rotor increases the power for flying upward in which the power increment is proportional to E;

wherein if E is positive, representing a current altitude of the vehicle is higher than the selected altitude, the rotor decreases the power for flying downward in which the power decrement is proportional to E; and wherein if E is zero or approximate zero, representing the current altitude of the vehicle is same as selected altitude, the power of the rotor remains unchanged.

23. A method as claimed in claim 21 wherein the selected altitude is set by setting a throttle level from a transmitter.

24. A system of remote controlling an altitude of a toy flying vehicle intended for indoor operation, the vehicle having a rotor for rotation relative to a fuselage of the vehicle, and a separate remote controller for use by a player of the toy, the system comprising a processor, a transmitter, a receiver, and a non-volatile computer readable medium comprising executable instructions which, when executed by the processor, cause the system to perform the following method:

(a) providing a relative selected altitude level r'd corresponding to a selected altitude for the vehicle;

(b) transmitting a position control signal with a light intensity I from the vehicle towards a surface;

(c) determining if a reflected signal of said position control signal is received from the surface;

(d) increasing a counter CNT if said reflected signal is received;

(e) increasing said light intensity I;

(f) repeating steps (b)-(e) while said light intensity I is less than a maximum value; and (g) determining a relative altitude r' and adjusting rotor action according to a difference between the relative altitude r' and the relative selected altitude level r'd to retain the selected altitude, wherein said determining the relative altitude r' comprises selecting the relative altitude r' from a table comprising correlations between values for the relative altitude r' and values for the counter CNT.

* * * * *